US006082387A

United States Patent [19]

Kanazashi et al.

[11] Patent Number: 6,082,387

[45] Date of Patent: Jul. 4, 2000

[54] TORNADO GENERATION METHOD AND APPARATUS

[75] Inventors: Tadashi Kanazashi; Kazumasa Yonedo, both of Higashi-Katsushika-gun, Japan

[73] Assignee: Tornex, Inc., Tokyo, Japan

[21] Appl. No.: 09/008,403

[22] Filed: Jan. 17, 1998

[30] Foreign Application Priority Data

Jan. 20, 1997 [JP] Japan ..... 9-041320

[51] Int. Cl.[7] ..... F15C 1/16

[52] U.S. Cl. ..... 137/14; 809/810; 809/811; 809/813

[58] Field of Search ..... 137/808, 809, 137/810, 811, 812, 813, 14

[56] References Cited

U.S. PATENT DOCUMENTS

| | | | |
|---|---|---|---|
| 2,910,830 | 11/1959 | White | 137/810 |
| 3,447,383 | 6/1969 | Camarata | 137/809 |
| 4,003,405 | 1/1977 | Hayes et al. | 137/810 |
| 4,197,869 | 4/1980 | Moncrieff-Yeates | 137/808 |

FOREIGN PATENT DOCUMENTS

| | | | |
|---|---|---|---|
| 2030852 | 1/1971 | Germany | 137/812 |
| 1004672 | 3/1983 | U.S.S.R. | 137/809 |

*Primary Examiner*—A. Michael Chambers
*Attorney, Agent, or Firm*—Bauer & Schaffer, LLP

[57] ABSTRACT

A tornado generating method and apparatus in accordance with the present invention can generate a tornado without forming an enclosed space and forcedly generating a spiral flow therein, and an object of the present invention is to ensure a wide collection range with vortex convergency of the tornado. In particular, a fluid flow in a fixed direction is brought into contact with a discontinuous fluid flow flowing in the reverse direction, remaining in a static state and flowing with a different rate relative to said fluid flow, or an object, to form a discontinuous plane therebetween. By sucking a fluid from at least one end of the axial direction of a plurality of vortexes generated on the discontinuous plane, the plurality of vortexes can be converged to form a core of a tornado in a free space, thereby artificially generating a tornado toward the sucking direction and a wide range of collection is ensured by the vortex convergency of the tornado.

21 Claims, 13 Drawing Sheets

Prior Art

Prior Art

TORNADO GENERATION METHOD AND APPARATUS

BACKGROUND OF THE INVENTION

1. Field of the Invention

The present invention relates to a tornado generating method and apparatus for artificially generating a tornado in a fluid, and utilizing the characteristics of the tornado to suck and eliminate a contaminated fluid by the tornado.

2. Description of the Related Art

For a conventional tornado generating method, as shown in FIG. 1, a method is known, wherein a barrel a which is substantially enclosed is provided with blow-out nozzles b, air is blown from these blow-out nozzles along a side wall c of the barrel a and sucked from a suction port d at the same time, thereby allowing a tornado t to be generated. This is a so-called in-pipe tornado, and is the oldest one of known tornado generating methods.

For another tornado generating method, as shown in FIG. 2, a method is known wherein a box e with an open front for use as a hood is provided with two suction ports d on the top surface thereof and with blow-out pipes g on both sides of an open portion f, air is blown from the two blow-out pipes g to form air curtains h and sucked from the two suction ports d at the same time, thereby allowing two tornadoes t to be formed in the box e. This method allows persons to work even when smoke, a hazardous gas and a large amount of dust exist in a box e serving as a hood.

In addition, for another tornado generating method, as shown in FIG. 3, a method is known wherein four blow-out pipes g for blowing air to form air curtains h are arranged in parallel with each other such that their blowing directions form the same rotation, spiral flows i are formed by the wake flow action of the air curtains h from the blow-out pipes g, and a suction port d is provided on at least one end of both ends of the axis direction of the blow-out pipes g to be located in the axial direction of the spiral flows i, and a shield plate j is provided in at least other of the both end surfaces. In this method, air is blown from the blow-out pipes g and sucked from the suction port d at the same time, thereby generating a tornado t toward the suction port d in the space surrounded by the air curtains h (disclosed in U.S. Pat. No. 5,096,467 owned by the Applicant).

For another tornado generating method, as shown in FIG. 4, a method is known wherein a curved plate k is provided with a shielding plate j on both ends thereof and with a suction port d on at least one end of the shielding plate j, and a blow-out pipe g is provided on one end of the curved direction of the curved plate k and the direction in which air is blown from the blow-out pipe g is directed within 90 degrees from a plane l connecting both ends of the curved plate k to the opposite side of the curved plate k. In this method, air is blown from the blow-out pipe g and sucked from the suction port d at the same time to form a spiral flow i between an air curtain h and the curved plate k, thereby generating a artificial tornado horizontally toward the suction port d (disclosed in J. P. Application No.2-290452 by the Applicant).

The conventional tornado generating methods mentioned above, however, effectually utilizes wall surfaces and air blows to surround a predetermined space for forcedly generating a spiral flow (vortex) in the space and sucking air from the axis direction of the vortex, thereby generating a tornado. In particular, according to the concept of Rankine's vortex, the vortex includes an outside free vortex and a forced vortex inside thereof, and the conventional tornado generating methods utilize wall sides and air blows to give energy to the outside free vortex and drive the inside forced vortex which is the core of a tornado.

From this point of view, the tornado generating methods mentioned above will hereinafter be examined.

In the tornado generating method as shown in FIG. 1, air is blown from the blow-out nozzles b along the side wall c of the barrel a to forcedly form a spiral flow and air is blown from the suction port d to generate the tornado t. Thus, the inside forced vortex which is the core of the tornado is driven by the outside free vortex.

In the tornado generating method as shown in FIG. 2, the box e and the air curtains h from two blow-out pipes g on both sides of the open surface of the box e substantially enclose the box e. In this method, air is sucked from the suction ports d to forcedly changes the air curtains h into two spiral flows with different rotational directions to generate two tornadoes t. Thus, the inside forced vortex which is the core of the tornado is driven by the outside free vortex similar to the method in FIG. 1.

In the tornado generating method as shown in FIG. 3, four air curtains h from four blow-out pipes g, a shielding plate j and a floor surface form an enclosed space. In this method, the spiral flow i is forcedly formed by the wake flow action of the air curtains h in the enclosed space and air is sucked from the suction port d, thereby generating the tornado t. Thus, the inside forced vortex which is the core of the tornado is driven by the outside free vortex similar to the method in FIGS. 1, 2.

In the tornado generating method as shown in FIG. 4, the curved plate k, the shielding plate j provided on both ends thereof and the air curtain h from the blow-out pipe g provided at one end of the curved plate k form a substantially enclosed space. In this method, the spiral flow i is forcedly formed by the wake flow action of the air curtain h in the enclosed space and the action of the curved plate k, i.e. the action that an air flow generated by sucking air from the suction port d becomes a rotationnal flow along the curved plate k, and then air is sucked from the suction port d, thereby generating the tornado t. Thus, the inside forced vortex which is the core of the tornado is driven by the outside free vortex similar to the method in FIGS. 1, 2 and 3.

The prior art examples as shown in FIGS. 1, 2 and 3 are used for each purpose and sufficiently satisfy their purposes. All of the above-mentioned prior art examples, however, involve forming enclosed spaces with wall surfaces and air curtains or the like and driving the inside forced vortex which is the core of the tornado by the outside free vortex, in some places, so that it is difficult to surround a predetermined space with wall surfaces or the like. Furthermore, in order to forcedly generate the spiral flow in the enclosed space and change the spiral flow into the tornado and continue to generate them, any person or object is not allowed to be in at least the tornado portion. Thus, a large scale of partitions and various equipment are required at present, so that it is difficult to realize such apparatus.

OBJECT AND SUMMARY OF THE INVENTION

The present invention has been made in view of the above-mentioned situation, and an object of the present invention is to provide a tornado generating method and apparatus for generating a tornado without forming an enclosed space to forcedly generate a spiral flow in the space, to ensure a wide collecting range by the vortex convergency and suck a contaminated fluid which may be then cleaned as required.

As a result of the inventors' devoted researches to achieve the above-mentioned object, it was revealed that although the fact that a plurality of vortexes are generated on a discontinuous plane in a fluid flow is known, these vortexes are considered as troublesome because they act as resistance in terms of fluid dynamics, and the previous studies were focused on how to prevent these vortexes from being generated. The inventors, however, found that the plurality of vortexes are converged to generate a tornado toward the suction direction by sucking a fluid from the axis direction of the plurality of vortexes.

In addition, the inventor found from the research for utilization of the tornado that a surrounded space by wall surfaces and air curtains or the like are not particularly required for generating the discontinuous surface, and ended up with completing the present invention.

In other words, the present invention is realized by sucking a fluid from the axial direction of a plurality of vortexes generated on a discontinuous plane of the fluid to converge the plurality of vortexes and generate a tornado toward the sucking direction.

DESCRIPTION OF THE PREFERRED EMBODIMENT

Various embodiments in accordance with the present invention will hereinafter be described with reference to FIGS. 5 to 25.

Figure 1:
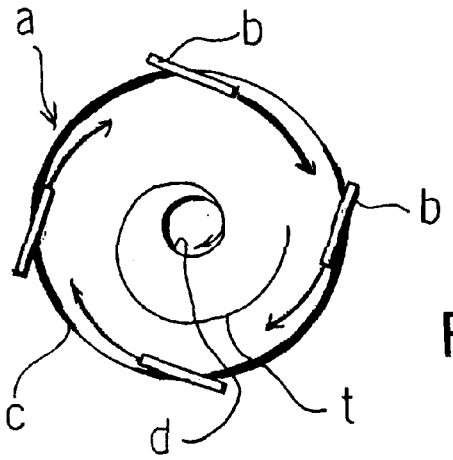
FIG. 1 is a cross-sectional view illustrating a prior art example.
Figure 2:
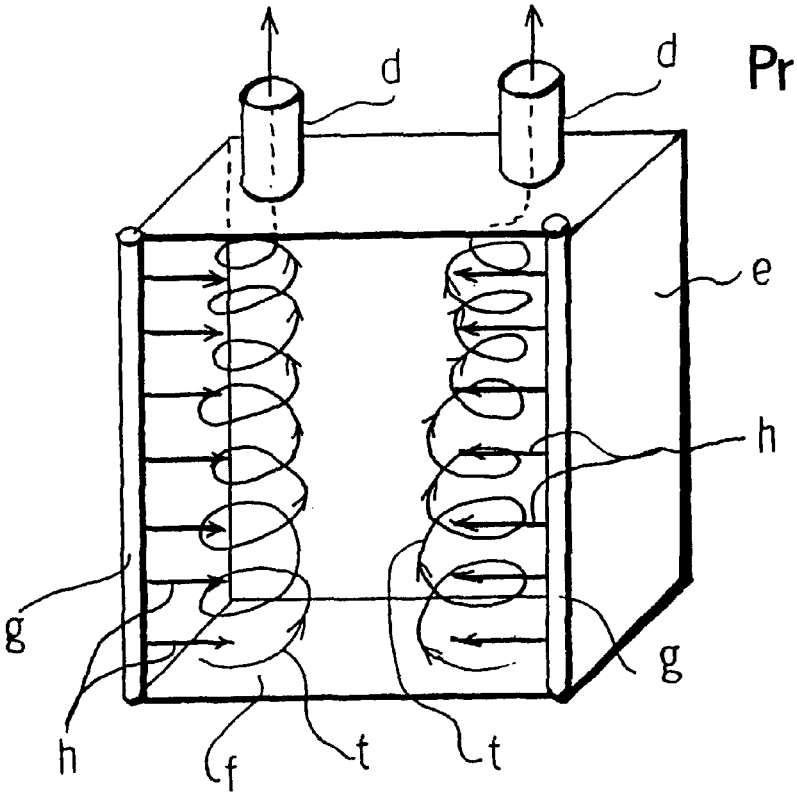
Prior Art Fig2
FIG. 2 is a perspective view illustrating a prior art example.
Figure 3:
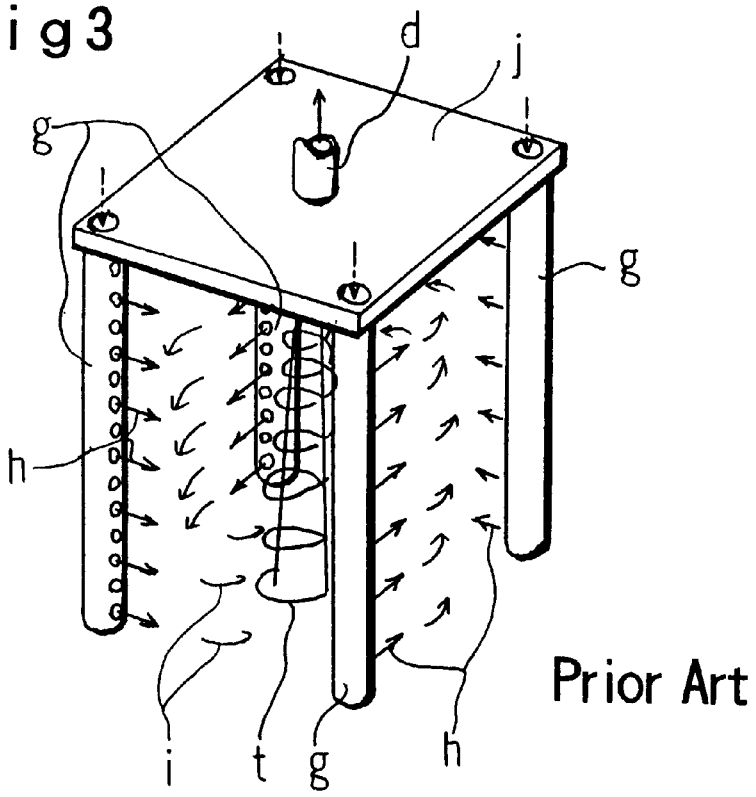
FIG. 3 is a perspective view illustrating a prior art example.
Figure 4:
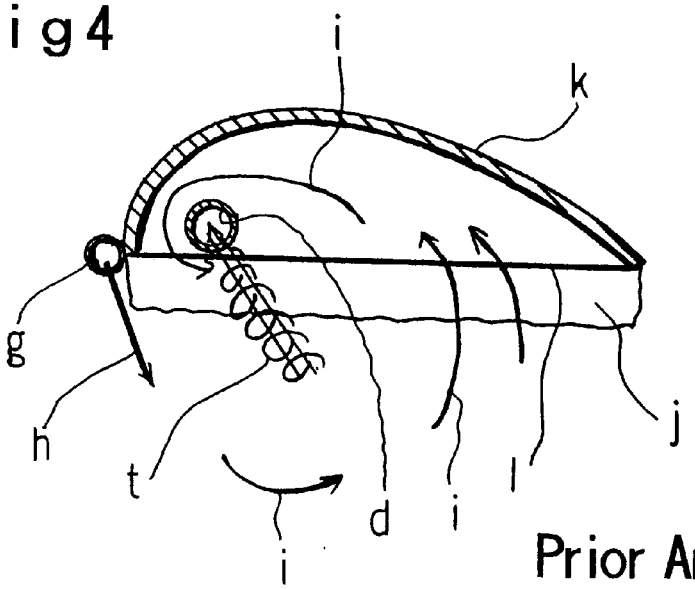
Prior Art Fig4
FIG. 4 is a cross-sectional view illustrating a prior art example.
Figure 5:
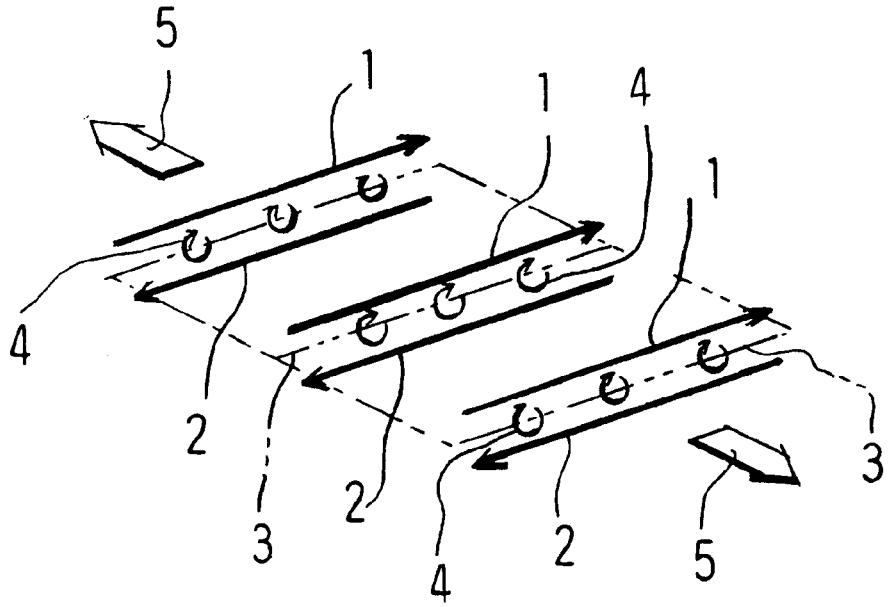
FIG. 5 is a perspective view illustrating a conceptual structure for describing a tornado generating method in accordance with the present invention.

In relation to FIGS. 5 to 9, a tornado generating method in accordance with claims 1 and 2 is described. In FIG. 5, fluid flows 1 travel in the right direction and discontinuous fluid flows 2 travel in the left direction in FIG. 5, i.e. in the reverse direction under the fluid flows 1, and discontinuous planes 3 are generated between the fluid flows 1 and 2. It is known that a plurality of vortexes 4 are generated on the discontinuous plane 3. The plurality of vortexes 4 are treated as troublesome because they cause air resistance for means of transportation such as airplanes, express trains and so on, and cause water resistance for ships. In the method in accordance with the present invention, however, the fluid is sucked from the axis direction 5 of the plurality of vortexes 4 (see FIG. 6) which are considered troublesome, so that the energy of the plurality of vortexes 4 is converged to form a core 6 of a tornado for the free vortex to whirl around the core 6, thereby artificially generating a tornado 7 toward the suction direction of the fluid (see FIG. 7). Thus, according to the concept of Rankine's vortex, the energy is first concentrated to the forced vortex to directly form a core of a tornado and then the free vortex is driven around the core to generate a tornado, so that it is a creation of a new tornado generating technique in contrast with the conventional tornado generating technique for driving the inside forced vortex which is the core of a tornado by the outside free vortex.

It should be noted that although the tornado t can be generated by sucking the fluid from one end of the axis direction 5 of the plurality of vortexes 4, the tornado t can be stably generated by sucking the fluid from both ends of the axis direction 5.

It is not particularly limited how to generate the above-mentioned upper fluid flow 1 and lower discontinuous fluid flow 2. They can be any fluid flow generated with natural wind, water flow, or one generated by blowing from a fan or a pump, or by sucking. The important point is that the fluid flow has directivity and the directivity is not changed over time. The fluid flow whose directivity is changed over time makes it difficult to generate a stable tornado 7 and to utilize the tornado 7 for engineering purposes. Thus, for engineering utilizations of the tornado 7, the use of a fluid flow generated with equipment controllable by a person such as a fan or pump yields a good result. However, this does not mean to eliminate the utilization of natural fluid flow.

It is not limited how to generate the above-mentioned discontinuous plane 3, and various generating methods exist as illustrated below. Any generating method may be permitted as long as a plurality of vortexes 4 are generated on the discontinuous plane 3.

The above-mentioned axial direction 5 is common to the plurality of vortexes and is not the axial direction corresponding to each vortex 4. By sucking the fluid from the common axial direction, the energy of each vortex 4, i.e. the force vortex having a vorticity is concentrated to form a core of a tornado.

The above-mentioned tornado 7 can be easily generated according to the method of the present invention by sucking the fluid from the axis direction 5 of the plurality of vortexes 4 generated on the discontinuous plane 3. The characteristics in related to the easily-generated tornado 7 will be hereinafter described. The tornado has common characteristics even though it is generated naturally or artificially by any method.

(1) Sucking directivity

A flow rate is hardly changed even far from the sucking point of the axis direction 5. This means that sucking has directivity and a contaminated fluid far from the sucking point can be directly sucked and collected.

(2) Flow rate accelerability

The contaminated fluid sucked and collected in tornado is converged toward its center and the flow rate is accelerated. This means that the contaminated fluid can be collected without spattering.

(3) Flexibility

The core 6 is extended uniformly substantially along the center of tornado 7. This means that a tornado can be freely formed not only in the cross direction but also in the longitudinal, diagonal and curved directions.

(4) Flow rate selectability

When a centrifugal force is balanced with a centripetal force, a tornado can be generated at a low rate of about 0.5 m/sec to a high rate of about 20 m/sec and this means that dust with a low specific gravity can be sucked and collected.

Figure 6:
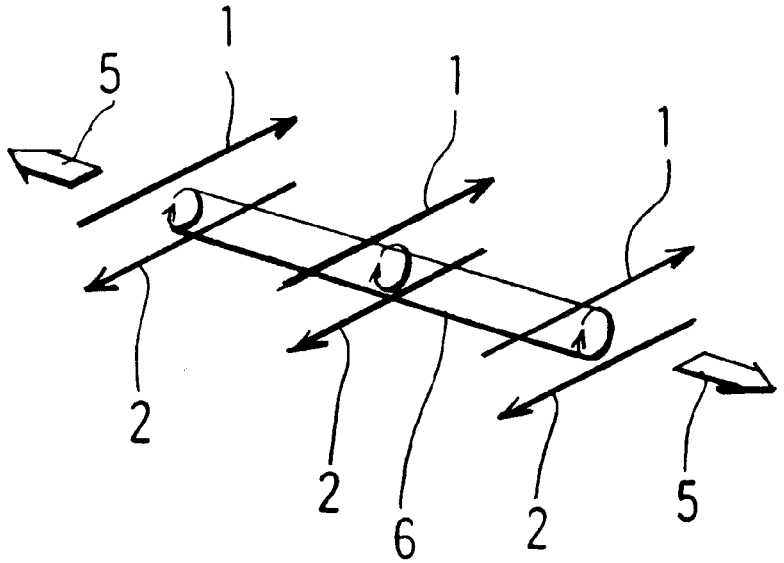
FIG. 6 is a perspective view illustrating a conceptual structure for describing a method in accordance with the present invention.
Figure 7:
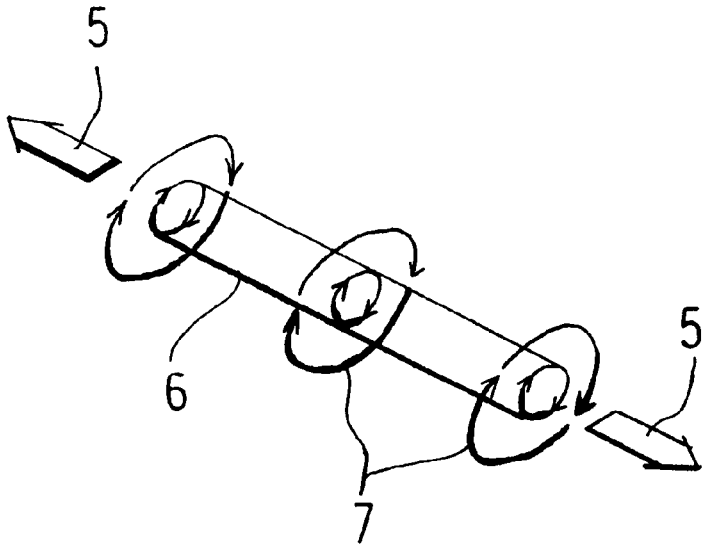
FIG. 7 is a perspective view illustrating a conceptual structure for describing a method in accordance with the present invention.
Figure 8:
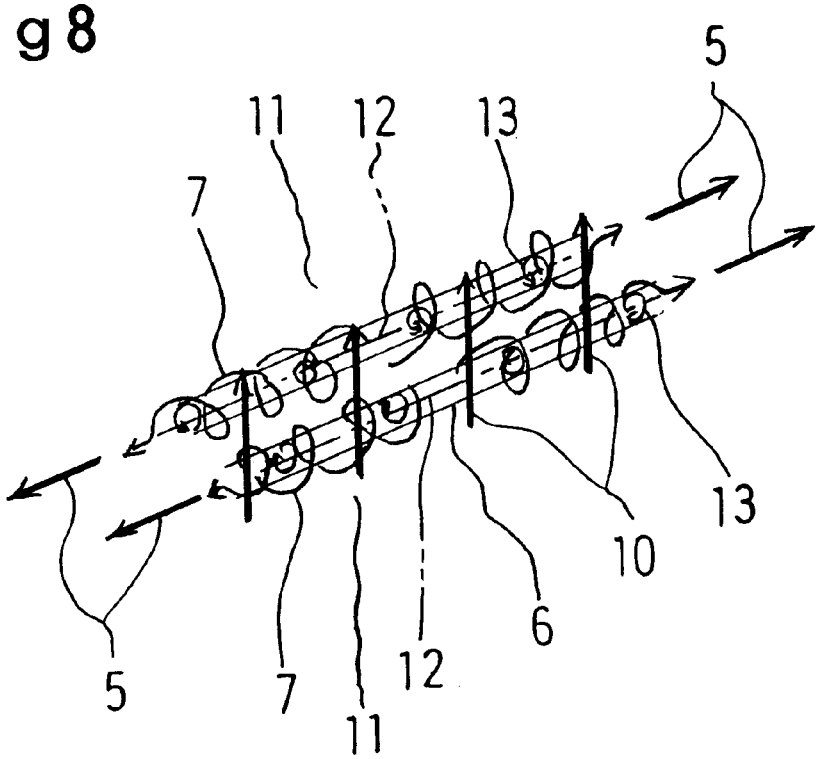
FIG. 8 is a perspective view illustrating a conceptual structure for describing another tornado generating method in accordance with the present invention.

The tornado generating method shown in FIG. 8 differs from the method shown in FIGS. 5 to 7 in that discontinuous planes 12 are generated by discontinuous fluid flows 11, which are static fluids on both sides of fluid flows 10 in the fixed direction, to generate a plurality vortexes 13 on the discontinuous plane 12, and the fluid is sucked from at least one end of the axial direction 5 of the plurality of vortexes 13, so that tornadoes 7 are generated artificially toward the axial direction 5 which is the sucking direction of the fluid similar to FIG. 7. In this case, the discontinuous plane 12 is formed on both ends of the fixed-direction fluid flow 10 so that the plurality of vortexes 13 are generated on each discontinuous plane 12. Thus, the tornadoes 7 are generated on both ends of the fixed-direction fluid flow 10.

Figure 9:
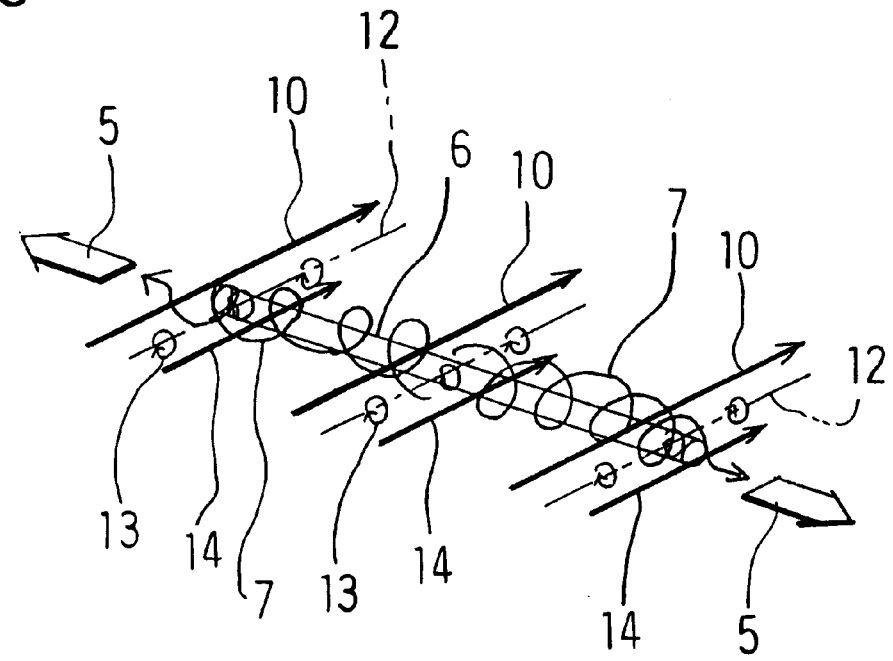
FIG. 9 is a perspective view illustrating a conceptual structure for describing another method in accordance with the present invention.

The tornado generating method shown in FIG. 9 differs from the method shown in FIGS. 5 to 7 in that discontinuous planes 12 are generated by discontinuous fluid flows 14 with a different rate and the same direction with respect to the fixed-direction fluid flow 10 to generate a plurality of vortexes 13 on the discontinuous surfaces 12. The remaining portions are the same as the method shown in FIGS. 5 to 7, so that the description is omitted.

In relation to FIGS. 10 to 13, a tornado generating method in accordance with claims 1 and 3 is described.

Figure 10:
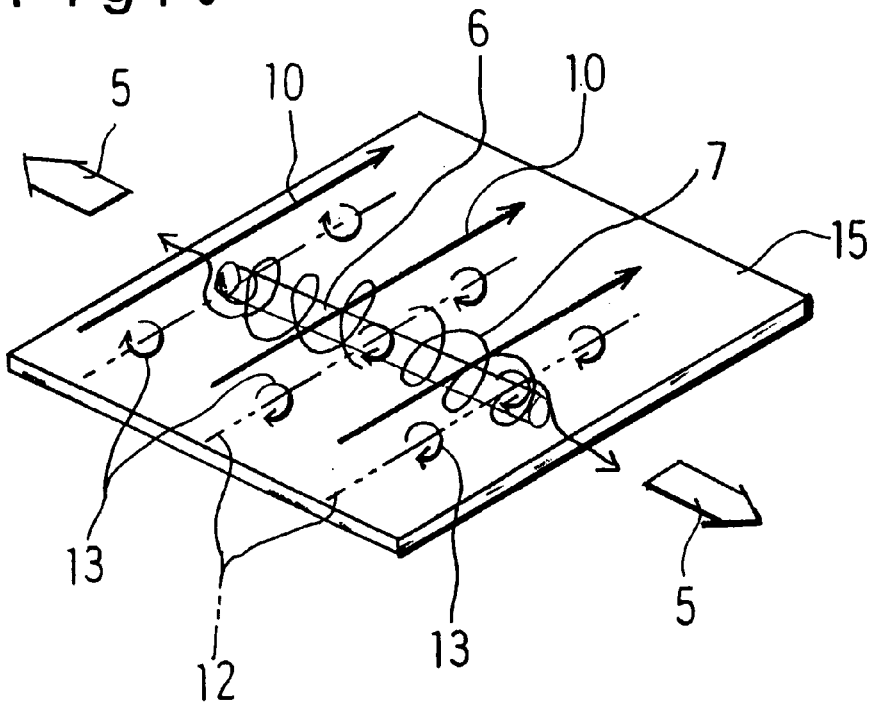
FIG. 10 is a perspective view illustrating a conceptual structure for describing another method in accordance with the present invention.

The tornado generating method shown in FIG. 10 differs from the method shown in FIGS. 5 to 7 in that discontinuous planes 12 are generated by fixed-direction fluid flows 10 in contact with an object 15 to generate a plurality of vortexes 13 on the discontinuous plane 12. The remaining portions are the same as the method shown in FIGS. 5 to 7 so that the description is omitted.

Figure 11:
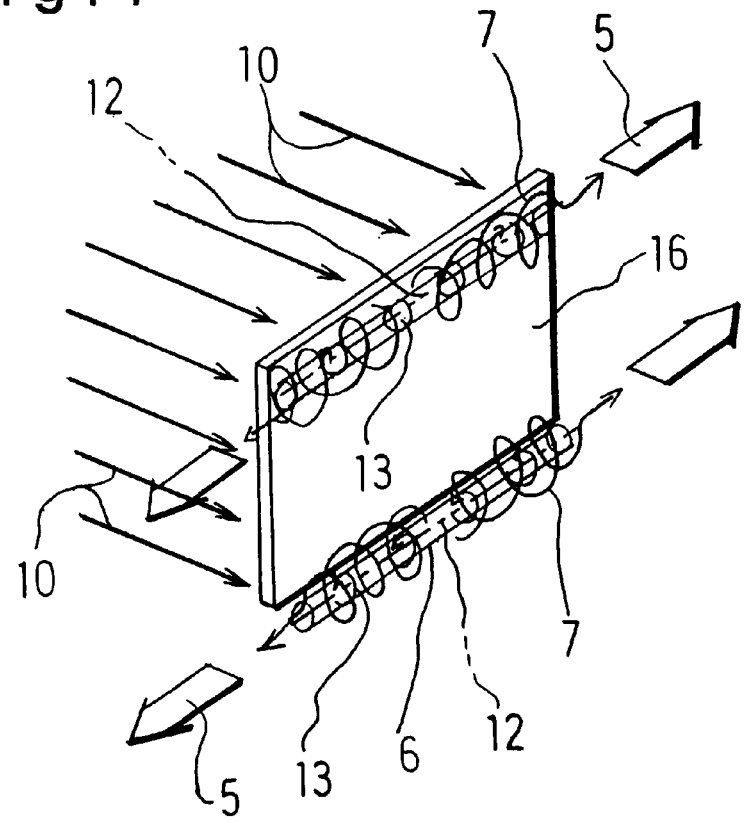
FIG. 11 is a perspective view illustrating a conceptual structure for describing another method in accordance with the present invention.

The tornado generating method shown in FIG. 11 differs from the method shown in FIG. 10 in that discontinuous planes 12 are generated near a plate (object) 16 by placing the plate 16 in constant fluid flows 10 to generate a plurality of vortexes on the discontinuous plane 12. It should be noted that although the plate 16 in FIG. 11 is a quadrangle so that the discontinuous planes 12 are generated at the four ends (four sides) of the quadrangle, the discontinuous planes 12 are shown as generated on two ends in FIG. 11 for convenience. The remaining portions are the same as the method shown in FIG. 10 so that the description is omitted.

Figure 12:
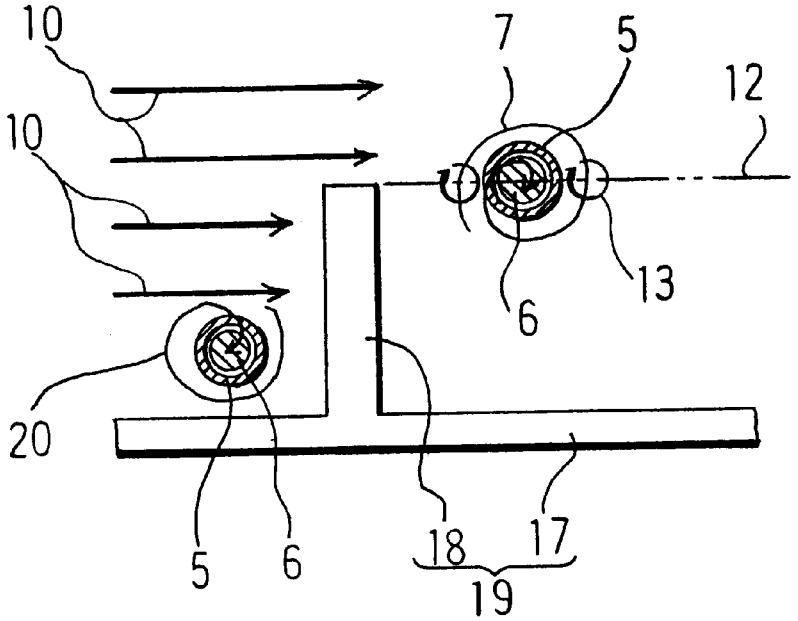
FIG. 12 is a side view illustrating a conceptual structure for describing another method in accordance with the present invention.

The tornado generating method shown in FIG. 12 differs from the method shown in FIG. 11 in that a discontinuous plane 12 is generated near the upper end of a perpendicular plate 18 by placing an inversed T-shaped plate (object) 19 comprising a bottom plate 17 and a perpendicular plate 18 implanted thereon in fixed-direction fluid flows 10 to form a plurality of vortexes 13 on the discontinuous plane 13. It should be noted that although a plurality of vortexes 20 are also generated between the bottom plate 17 and the perpendicular plate 18 and roll up, a tornado 7 can be similarly generated by sucking the fluid from the axis direction 5 of the vortexes 20. The remaining portions are the same as the method shown in FIG. 10 so that the description is omitted.

Figure 13:
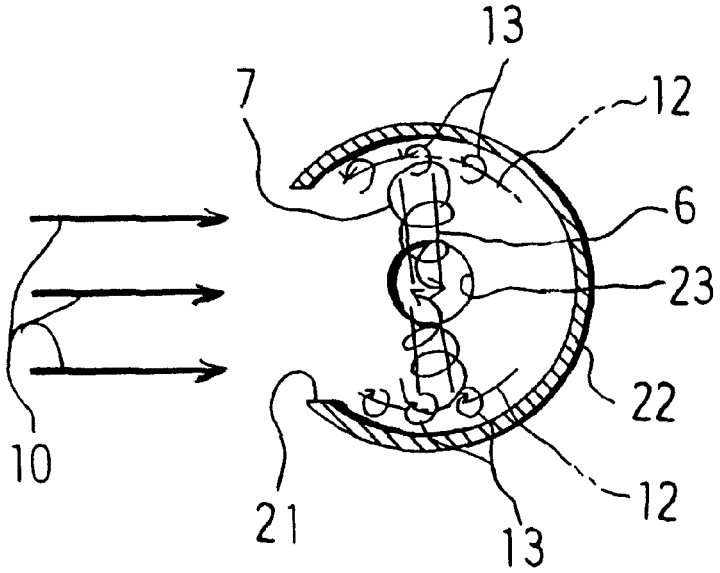
FIG. 13 is a cross-sectional view illustrating a conceptual structure for describing another method in accordance with the present invention.

The tornado generating method shown in FIG. 13 differs from the method shown in FIG. 11 in that discontinuous planes 12 are generated in a cylinder (object) 22 by placing the cylinder comprising a notch 21 though a side wall in fixed-direction fluid flows 10 to form a plurality of vortexes 13 on the discontinuous planes 12. It should be noted that the discontinuous planes 12 are generated on both ends of the notch 21 of the cylinder 22 so that the plurality of vortexes 13 are generated on each discontinuous plane 12 in the cylinder 22. Thus, by sucking the fluid from at least one of the axial direction of two groups of the plurality of vortexes 13, i.e. from a suction port 23 in the axis direction of the cylinder 22, two tornadoes 7 can be artificially generated. It should be noted that this cylinder 22 may have any cross-sectional shape such as circle, ellipse, elongated circle, spiral and polygon having three anges or more and the like, and it is not particularly limited. The remaining portions are the same as the method shown in FIG. 10 so that the description is omitted.

Figure 14:
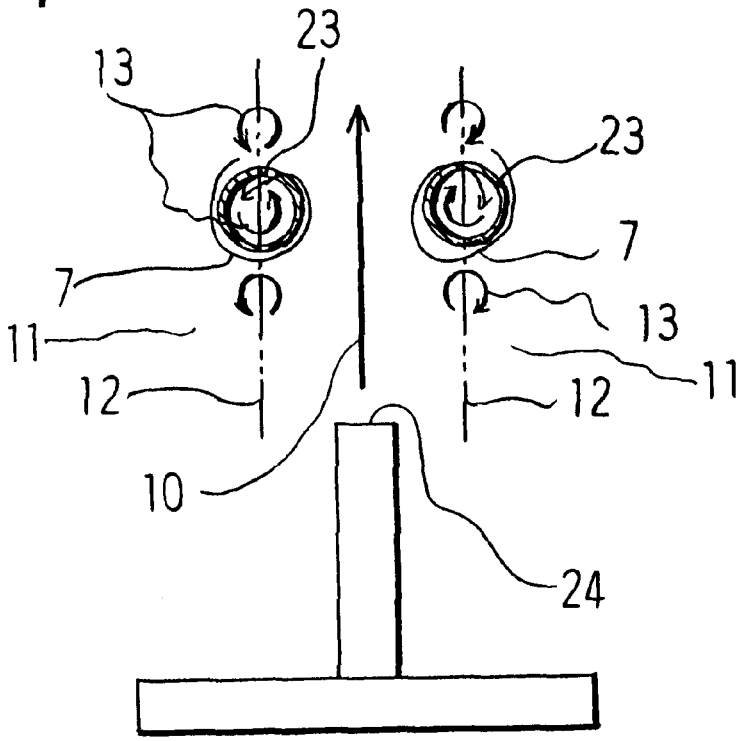
FIG. 14 is a side view illustrating a conceptual structure for describing another method in accordance with the present invention.

FIG. 14 illustrates the tornado generating method according to claims 1 and 2. In this tornado generating method, when a fixed-direction fluid flow 10 is blown from a blow-out port 24, two discontinuous planes 12 are generated by the constant fluid flow 10 and discontinuous fluid flows 11 which are static fluids on both sides of the fixed-direction fluid flow 10 to generate a plurality of vortexes 13 on each discontinuous plane 12. It should be noted that the tornado generating method is substantially similar to that in FIG. 8, except that the fixed-direction fluid flow 10 is blown from the blow-out port 24. Thus, two tornadoes 7 can be artificially generated by sucking the fluid from suction ports 23 in the axial direction of two groups of the plurality of vortexes 13.

Figure 15:
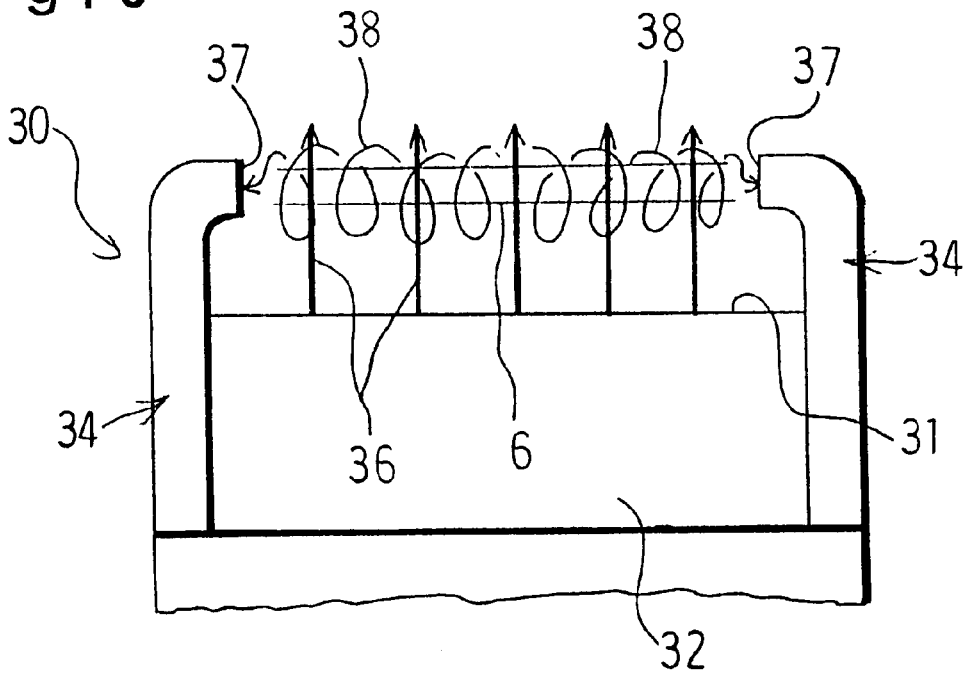
FIG. 15 is a side view describing another apparatus in accordance with the present invention.
Figure 16:
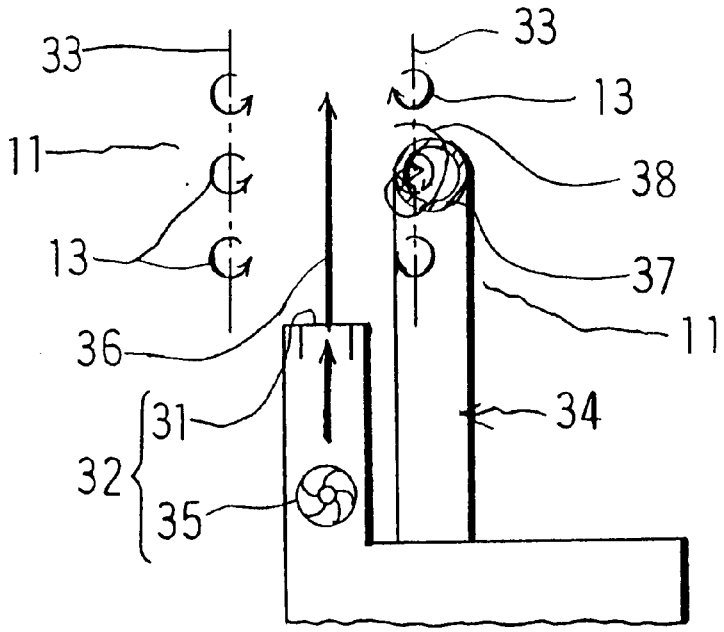
FIG. 16 is a front view describing another apparatus in accordance with the present invention.
Figure 17:
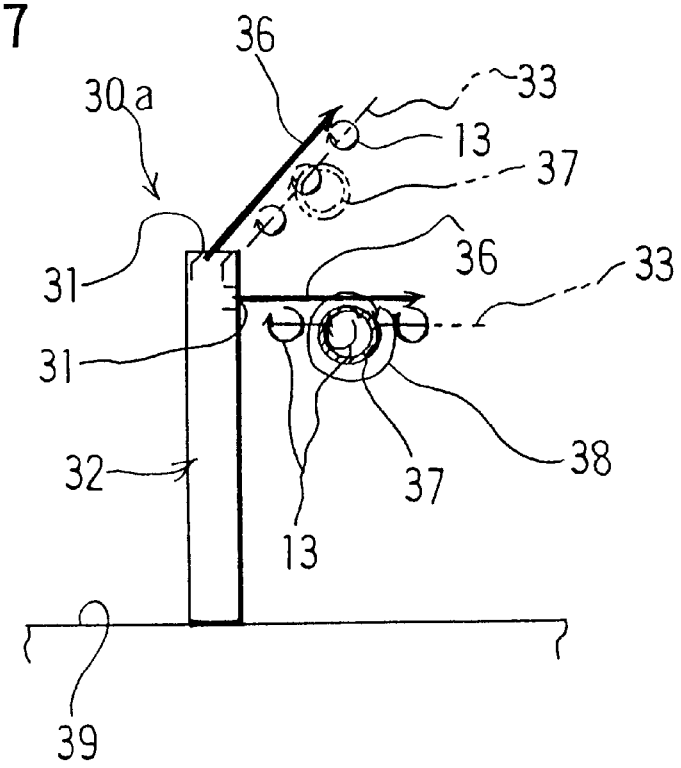
FIG. 17 is a side view describing another apparatus in accordance with the present invention.
Figure 18:
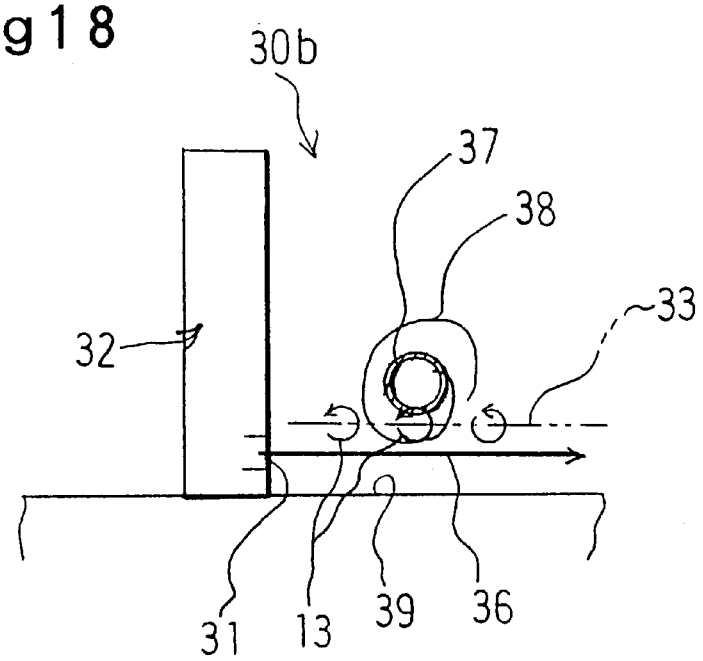
FIG. 18 is a side view describing another apparatus in accordance with the present invention.
Figure 19:
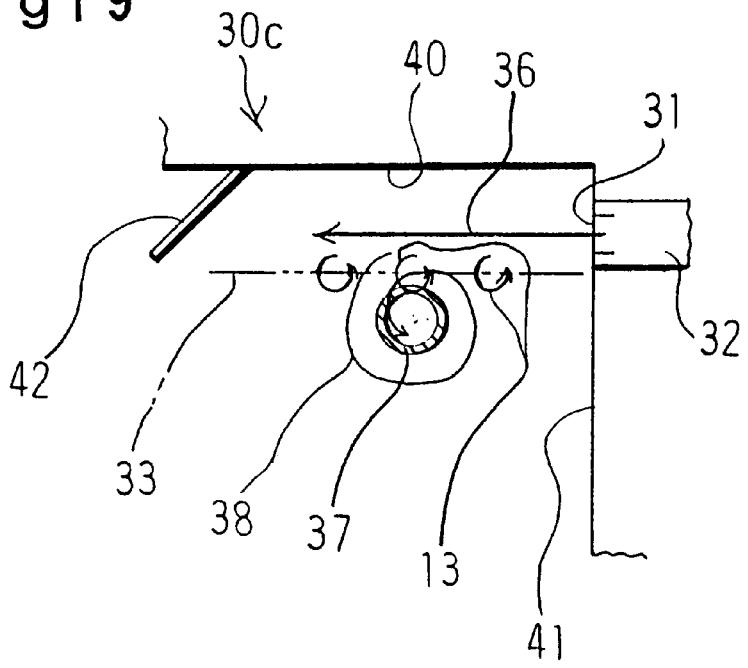
FIG. 19 is a side view describing another apparatus in accordance with the present invention.
Figure 20:
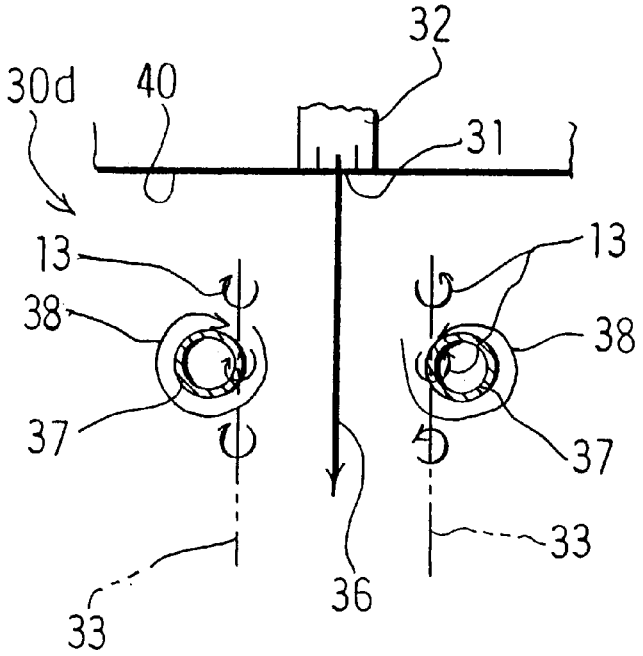
FIG. 20 is a side view describing another apparatus in accordance with the present invention.

FIGS. 15 and 16 illustrates a tornado generating apparatus according to claim 4 and embodies the tornado generating method according to claims 1 and 2 shown in FIG. 14. The tornado generating apparatus 30 comprises a discontinuous plane generating unit 32 for blowing a fluid from a blow-out port 31 to form a fluid flow with a predetermined flow rate and generate discontinuous planes 33 between the fluid flow and a static fluid, and a suction unit 34 provided on both ends of the axial direction of a plurality of vortexes generated on said discontinuous plane 33. The discontinuous plane generating unit 32 has a blow-out port 31 connected to the delivery side of a flow-through type fan, while the suction unit 34 has a suction port 37 connected to the suction side of a fan (not shown), and an air cleaner (not shown) may also be connected at the delivery side of the fan. By activating the flow-through type fan 35 to blow air-curtain shaped fluid flows 36 from the blow-out port 31, generating the discontinuous planes 33 on both sides of the air-curtain shape fluid flows 36 and activating the fan connected to the suction unit 34 to suck the fluid from the suction port 37, a plurality of vortexes 13 generated on the discontinuous plane 33 are converged to generate a tornado 38 toward the suction port 37 even in a perfectly free space. However, if the blowing speed of the air-curtain shaped fluid flow 36 is too fast, the position of the suction port 37 is offset due to the fluid flow going through, so that the tornado 38 toward the suction port 37 may not be generated even if the plurality of vortexes 13 are generated on the discontinuous plane 33. It should be noted that the discontinuous planes 33 are generated on both sides of the fluid with a predetermined flow rate blown from the discontinuous plane generating unit 32 so that two tornadoes can be generated in a perfectly free space if another suction unit 34 is provided on the remaining side.

The above-mentioned tornado generating apparatus 30*a* can also be achieved with modifications shown in FIGS. 17 to 20. In a tornado generating apparatus 30*a* shown in FIG. 17, the blowing direction of a blow-out port 31 of a discontinuous plane generating unit 32 is made to have an arbitrary direction ranging from substantially horizontal direction to substantially vertical direction, and a suction port 37 is provided to be located in the axial direction of a plurality of vortexes 13 generated on a discontinuous plane 33 defined by an air-curtain shaped fluid flow 36 from the blow-out port 31. In the tornado generating apparatus 30*b* shown in FIG. 18, a blow-out port 31 is provided in a lower portion of a discontinuous plane generating unit 32 and a suction port 37 is provided to be located in the axial direction of a plurality of vortexes 13 generated on a discontinuous plane 33 defined by an air-curtain shaped fluid flow 36 along the floor 39 from a blow-out port 31. In the tornado generating apparatus 30*c* shown in FIG. 19, a blow-out port 31 of a discontinuous generating unit 32 is provided on the wall surface 41 near the ceiling 40 and, in addition, a plate 42 is provided on the ceiling 40 and a suction port 37 is provided to be located in the axial direction of a plurality of vortexes 13 generated on a discontinuous plane 33 defined by an air-curtain shaped fluid flow 36 along the ceiling 40. It should be noted that the discontinuous plane 33 and the plurality of vortexes are generated without the plate 42. In the tornado generating apparatus 30*d* shown in FIG. 20, a blow-out port 31 of a discontinuous plane generating unit 32 is provided on the ceiling 40 and a suction port 37 is provided to be located in the axial direction of a plurality of vortexes 13 generated on a discontinuous plane 33 defined by an air-curtain shaped fluid flow 36 blowing down from the ceiling 40.

Figure 21:
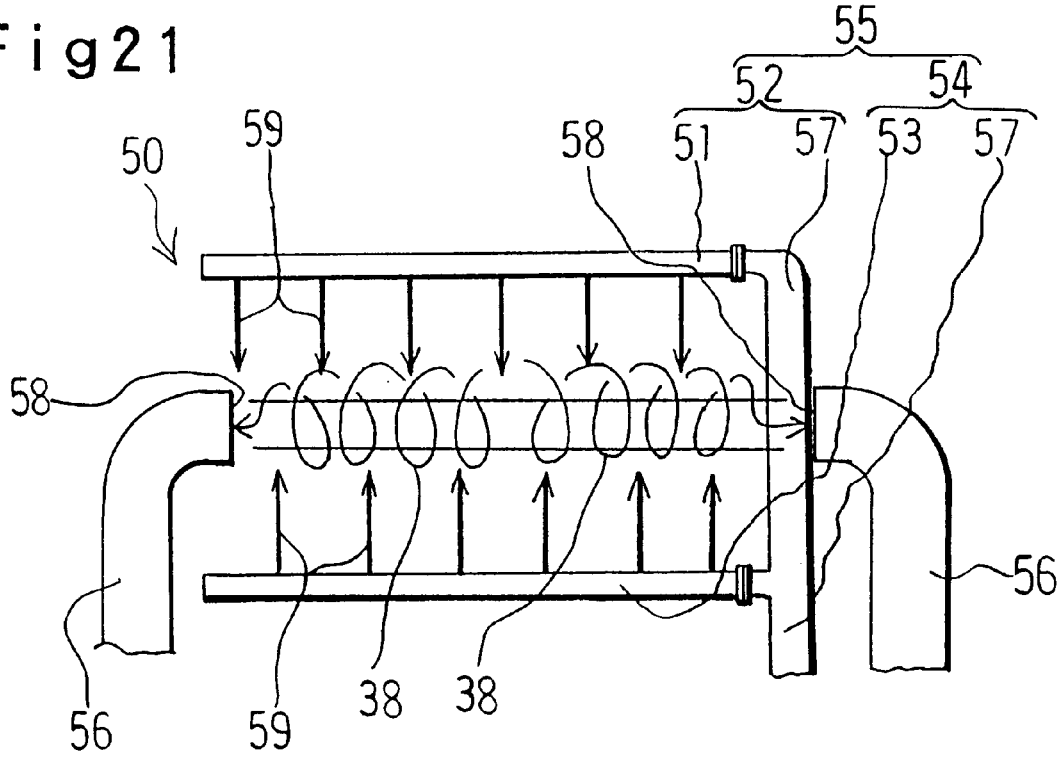
FIG. 21 is a side view describing another apparatus in accordance with the present invention.
Figure 22:
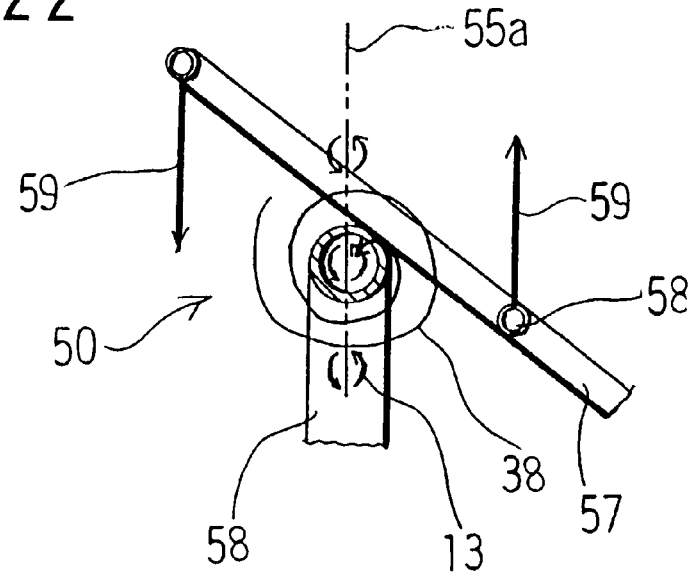
FIG. 22 is a front view describing another apparatus in accordance with the present invention.

FIGS. 21, 22 illustrate a tornado generating apparatus according to claim 5 and embody the method according to the present invention shown in FIGS. 5 to 7. A tornado generating apparatus 50 comprises a discontinuous plane generating unit 55 including a fluid flow generating portion 52 for blowing a fluid from a blow-out pipe 51 to form a fluid flow and a reverse fluid flow generating portion 54 for forming a fluid flow flowing in the reverse direction against the fluid flow by the fluid flow generating portion 52 and a suction unit 56 provided on both ends of the axis direction of a plurality of vortexes 13 generated on a discontinuous plane 55*a* generated between the fluids from the fluid flow generating portion 52, 54. The fluid flow generating portion 52 has a main pipe 57 connected to the delivery side of a fan (not shown) and a blow-out pipe 51 connected to the main pipe 57, and similarly the reverse fluid flow generating portion 54 has a main pipe 57 connected to the delivery side of a fan and a blow-out pipe 53 connected to the main pipe 57. The suction unit 56 has a suction port 58 connected to the suction side of a fan (not shown), and further an air-cleaner may be connected to the delivery side of the fan. When the fan is activated and air-curtain shaped fluid flows 59 are blown in reverse directions to each other from the opposing blow-out pipes 51, 53 to generate a discontinuous plane 55*a* between the two air-curtain shaped fluid flows 59, and fan connected to the suction unit 56 is activated to suck the fluids from the suction ports 58, so that a plurality of vortexes 13 generated on the discontinuous plane 55*a* are converged to generate a tornado 38 toward the suction ports 58.

Figure 23:
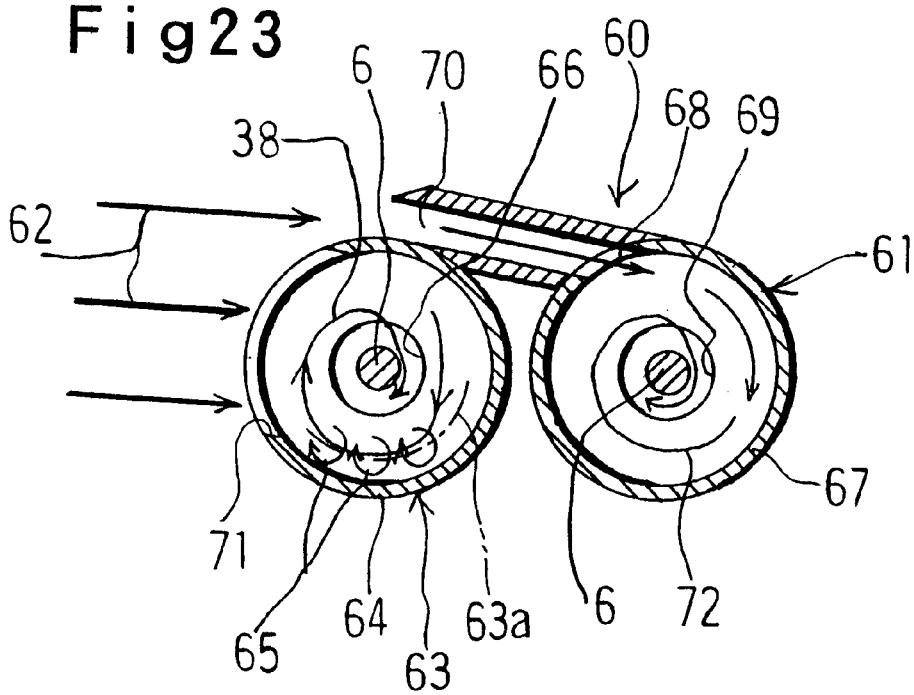
FIG. 23 is a cross-sectional view describing another apparatus in accordance with the present invention.
Figure 24:
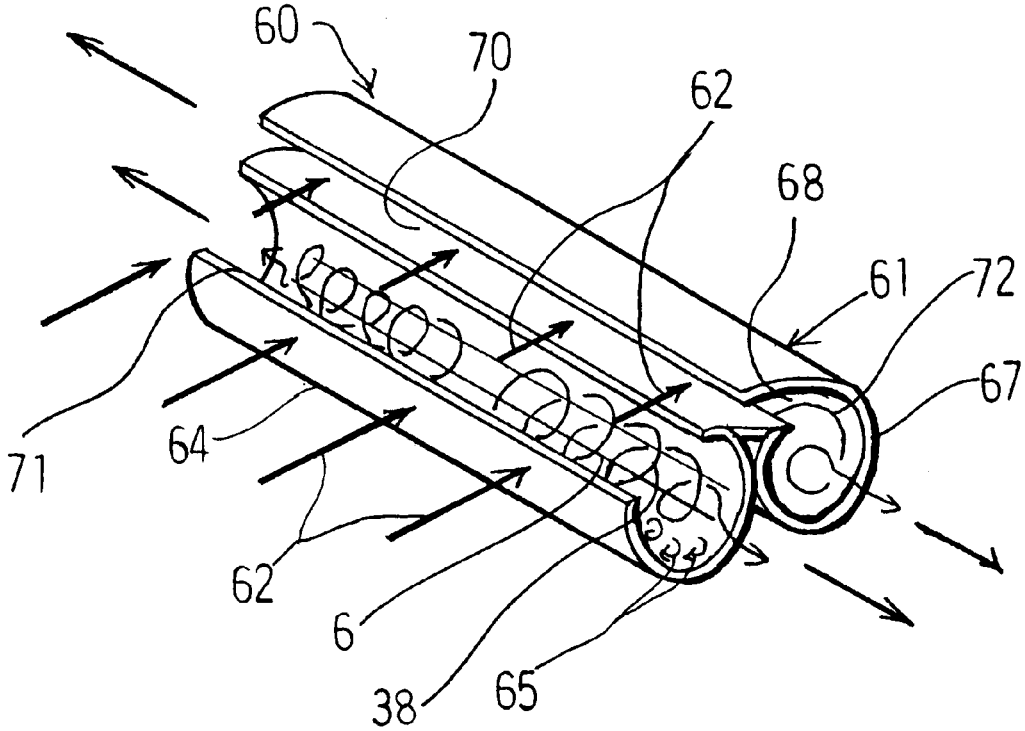
FIG. 24 is a perspective view describing another apparatus in accordance with the present invention.

FIGS. 23, 24 illustrate a tornado generating apparatus according to claims 6, 7 which embodies the method according to the present invention shown in FIG. 13. A tornado generating apparatus 60 consists of a fixed-direction fluid flow generating unit 61 for forming bi-directional fluid flows 62 and a discontinuous generating unit 63 for placing a cylinder (object) 64 in contact with the bi-directional fluid flows 62 generated by the bi-directional fluid flow generating unit 61 to form a discontinuous plane 63*a* therebetween and a suction unit 66 provided in the axis direction of a plurality of vortexes 65 generated on the discontinuous plane 63*a*. The bi-directional fluid flow generating unit 61 is provided with a notch 68 on the side wall of a suction cylinder 67 and with a suction port 69 on at least one end of the axis direction of the suction cylinder 67. This notch 68 is provided with a path 70 for introducing the bi-directional fluid flows 62 adjacent to a notch 71 of the cylinder 64. The suction port 69 of the bi-directional fluid flow generating unit 61 and the suction unit 66 are connected to the suction side of a fan (not shown) which may be further connected to an air-cleaner (not shown) as required.

When the fan is driven, the suction port 69 of the bi-directional fluid flow generating unit 61 is going to suck the fluids so that the fluid is sucked into the path 70 to form a spiral flow against the wall surface of the suction cylinder 67 and an in-pipe tornado 72 is generated. This in-pipe tornado 72 causes the fluids to be uniformly sucked from the opening of the path 70 to generate the bi-directional fluid flows 62. This fluid flows 62 enter into the cylinder 64 from the notch 71 near the opening of the path 70 to form a discontinuous plane 63*a*. A plurality of vortexes 65 are generated on the discontinuous plane 63*a* and fluids are sucked from said suction unit 66, so that the plurality of vortexes 65 are converged to generate a self-occurred artificial tornado 38 toward the suction unit 66. In this tornado generating apparatus 60, a contaminated fluid can be uniformly sucked even with a long notch 71 of the cylinder 64 and for achieving the uniform suction, the conventional in-pipe tornado generating technique is utilized to generate the fluid flow with a constant and uniform flow rate, and the tornado generating technique of the present invention is utilized to uniformly suck and eliminate contaminated fluids.

Figure 25:
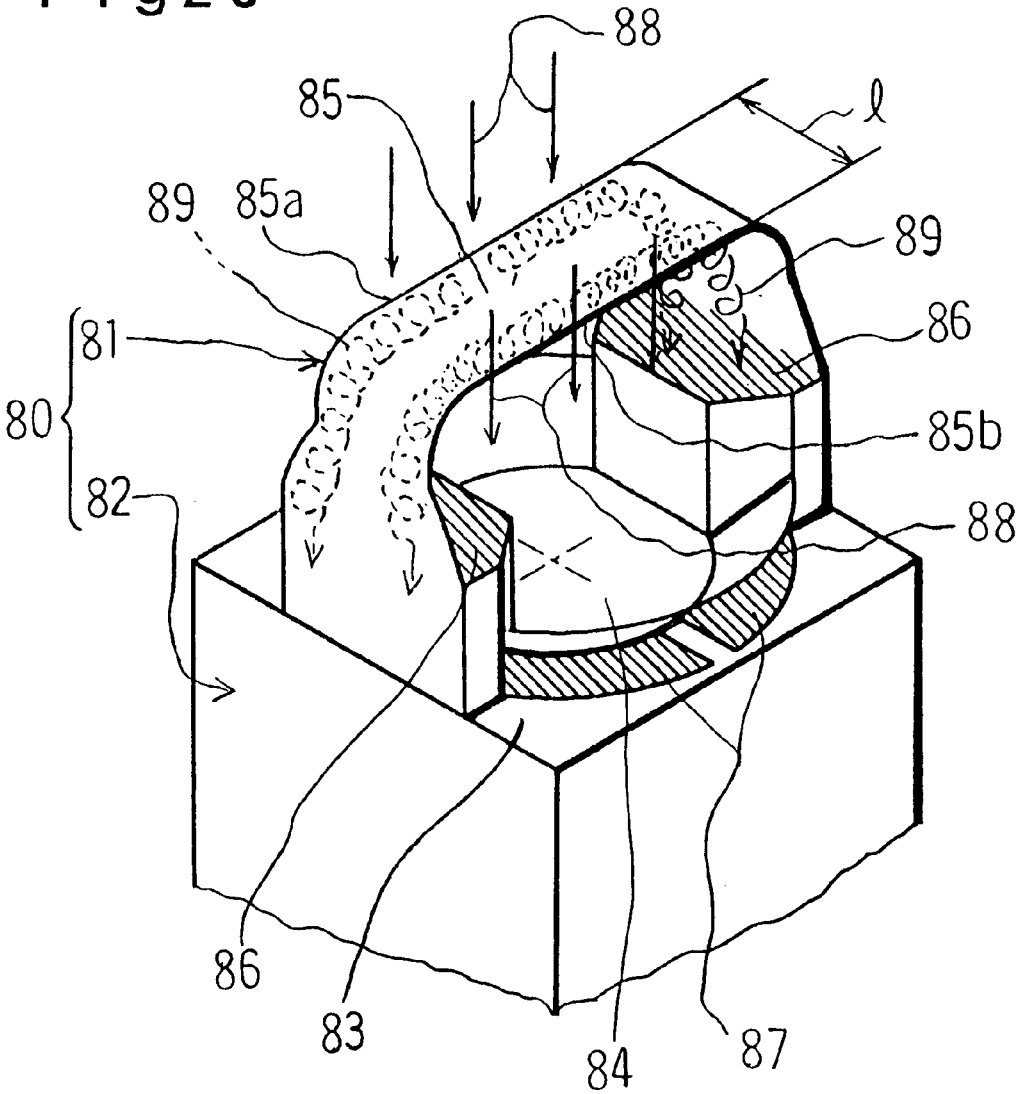
FIG. 25 is a perspective view illustrating a smoking stand utilizing a method in accordance with the present invention.

FIG. 25 illustrates a smoking stand utilizing the method according to the present invention shown in FIG. 13. This smoking stand 80 comprises an upper ashtray functional unit 81 and a lower stand 82. The ashtray functional unit 81 is constructed such that an ashtray 84 is carried on a plate 83 removably mounted on the stand 82, a U-shaped tornado guide 85 is mounted on both sides thereof, suction ports 86 are provided on both ends of the tornado guide 85, and a suction opening 87 is provided in the plate 83. The stand 82 has a cleaner and a suction fan (both are not shown) therein. With this smoking stand 80, when the suction fan is activated, an ambient air is sucked into the suction port 86 and the suction opening 87, thereby generating the bi-directional fluid flows 88 shown in FIG. 13, and a discontinuous plane is generated near both edges 85*a*, 85*b* of the tornado guide 85, a plurality of small vortexes are generated on the discontinuous plane and then converged to generate two tornadoes 89 rotating in reverse directions to each other toward the suction ports 86. Thus, even though a lit tobacco is left on the ashtray 84, the smoke is immediately drawn by the two tornadoes 89. In addition, the smoke puffed near the ashtray functional unit 81 is sucked into the suction opening 87. The smoke sucked by the suction ports 86 and the suction opening 87 is cleaned by the cleaner in the stand 82. It should be noted that two tornadoes 89 are guided by the tornado guide 85 in the above description, when width l of the tornado guide 85 is small, two tornadoes 89 may be converged into one of them with higher energy.

The tornado generating method and apparatus illustrated in FIGS. 5 to 24 are described for the case where a gas is specifically applied out of various fluids, it goes without saying that they may be applied to liquids such as water. In addition, the method and apparatus can be used for sucking contaminated air such as smoke of tobaccos, and the contaminated air sucked using the method and apparatus can be cleaned by sending it to a cleaner and the cleaned air can be used circularly.

As described above, according to claim 1, a tornado is generated only by sucking a fluid from at least one end of the axial direction of a plurality of vortexes generated on a discontinuous plane. Thus, a plurality of vortexes generated on a discontinuous plane, which are conventionally considered troublesome, are tranasformed into a useful tornado by a unique idea, and a discontinuous plane is generated in a free space, so that a tornadoes can be generated in a free space. Thus, a tornado can be generated and its vortex convergency allows for a wider range of collection to suck the contaminated fluids without forming an enclosed space to forcedly generate spiral flows therein.

According to claim 2, a discontinuous plane is formed by a discontinuous fluid flow against a fluid flow therebetween, so that a tornado is generated only by sucking a fluid from at least one end of the axial direction of a plurality of vortexes generated on the discontinuous plane.

According to claim 3, a discontinuous plane is formed between a fluid flow and an object, so that a tornado is generated only by sucking a fluid from at least one end of the axial direction of a plurality of vortexes generated on the discontinuous plane.

According to claim 4, a discontinuous plane is generated between a fluid flow at a predetermined flow rate from a discontinuous plate generating unit and static fluids on both sides thereof, so that a tornado is generated only by sucking a fluid from at least one end of the axial direction of a plurality of vortexes generated on the discontinuous plane.

According to claim 5, a discontinuous plane is generated between a fluid flow and an reverse fluid flow by a fluid flow and a reverse fluid flow generating units, so that a tornado is generated only by sucking a fluid from at least one end of the axial direction of a plurality of vortexes generated on the discontinuous plane.

According to claim 6, a discontinuous plane is generated between a fluid by a discontinuous plane generating unit and an object, so that a tornado is generated only by sucking a fluid from at least one end of the axial direction of a plurality of vortexes generated on the discontinuous plane.

According to claim 7, when a fluid is sucked from a suction port, the fluid entered from a notch is transformed into a spiral flow and into a tornado in a cylinder, and this tornado uniformly sucks the fluid from the notch. Thus, even though the longitudinal length of the notch is long, a contaminated fluid is uniformly sucked, thereby enabling the apparatus to be utilized as a suction apparatus for a long counter.

What is claimed is:

1. A method for generating a tornado comprising the steps of:

providing in a selected plane a first flow of fluid having a predetermined direction and rate of flow; and generating in a plane spaced from the selected plane a plurality of discontinuous vortexes having a common axial direction;

providing a second flow of fluid parallel to said selected plane and along said common axial direction; and controlling the relative speed and direction of each of said fluid flows within their respective planes to converge said plurality of vortexes to generate a tornado.

2. A method for generating a tornado according to claim 1, wherein the plane in which the vortexes are serenaded is parallel to said selected plane.

3. A method for generating a tornado according to claim 2, wherein said discontinuous vortexes are generated by a third flow of fluid in contact with said first fluid flow in a direction reverse to said direction of said first fluid flow.

4. A method for generating a tornado according to claim 2, wherein said discontinuous vortexes are generated by a third flow of fluid in contact with said first fluid flow having a rate of flow different from said rate of flow of said first fluid flow.

5. A method for generating a tornado according to claim 2, wherein said discontinuous vortexes are generated by a third flow of fluid in contact with said first fluid flow, said second fluid flow being discontinuous.

6. A method for generating a tornado according to claim 2, wherein said discontinuous vortexes are generated by providing a static fluid into which said first fluid flow is introduced.

7. A method for generating a tornado according to claim 2, wherein said discontinuous vortexes are generated by causing an object to be in contact with said first fluid flow.

8. A method for generating a tornado according to claim 1, wherein said common axial direction is perpendicular to said first fluid flow.

9. A method of generating a tornado according to claim 1, wherein said tornado is generated in an unenclosed area in space.

10. A method of generating a tornado according to claim 1, wherein said discontinuous vortexes are generated by providing a cylinder having a longitudinal wall and a longitudinal notch therein, said first fluid flow entering said cylinder through said notch, said discontinuous vortexes lying in a plane parallel to said wall of said cylinder, said common axial direction parallel to the axis of said cylinder.

11. A tornado generating apparatus comprising:

means for producing a first flow of fluid in a selected plane having a predetermined rate of flow and common direction;

means for generating a plurality of discontinuous vortexes within a plane, said vortexes having a common axial direction;

means for producing a second fluid flow along said common axial direction causing said plurality of vortexes to converge in order to generate a tornado.

12. A tornado generating apparatus according to claim 11, wherein the plane in which said plurality of vortexes lie is parallel to said selected plane.

13. A tornado generating apparatus according to claim 12 wherein said means for generating said discontinuous vortexes comprises a third flow of fluid, in contact with said first fluid flow, having a direction reverse to said direction of said first fluid flow.

14. A tornado generating apparatus according to claim 12 wherein said means for generating said discontinuous vortexes comprises a third flow of fluid in contact with said first fluid flow, having a rate of flow different from said rate of flow of said first fluid flow.

15. A tornado generating apparatus according to claim 12 wherein said means for generating said discontinuous vortexes provides a third flow of fluid, in contact with said first fluid flow, which is discontinuous.

16. A tornado generating apparatus according to claim 12 wherein said means for generating said discontinuous vortexes provides a static fluid into which said first fluid flow is introduced.

17. A tornado generating apparatus according to claim 12 wherein said means for generating said discontinuous vortexes provides an object in contact with said first fluid flow.

18. A tornado generating apparatus according to claim 11, wherein said common axial direction is perpendicular to said first fluid flow.

19. A tornado generating apparatus according to claim 11, wherein said first fluid flow is planar.

20. A tornado generating apparatus according to claim 11, wherein said apparatus is located in an unenclosed area in space.

21. A tornado generating apparatus according to claim 11, wherein means for generating discontinuous vortexes comprises a cylinder having a longitudinal wall and a longitudinal notch therein into which said first fluid flow enters, said discontinuous vortexes lying in a plane parallel to said wall of said cylinder, said common axial direction parallel to said axis of said cylinder.

* * * * *